United States Patent [19]

Adrian

[11] 4,367,686

[45] Jan. 11, 1983

[54] METHOD FOR OPERATING A COAL DUST FURNACE AND A FURNACE FOR CARRYING OUT THE METHOD

[75] Inventor: Fritz Adrian, Ratingen, Fed. Rep. of Germany

[73] Assignee: Steag Aktiengesellschaft, Essen, Fed. Rep. of Germany

[21] Appl. No.: 247,319

[22] Filed: Mar. 25, 1981

[51] Int. Cl.[3] ..... F23K 5/00

[52] U.S. Cl. ..... 110/347; 110/263; 110/264

[58] Field of Search ..... 110/260–263, 110/347

[56] References Cited

U.S. PATENT DOCUMENTS

| | | | |
|---|---|---|---|
| 2,616,252 | 11/1952 | Robinson et al. | 110/263 |
| 4,094,625 | 6/1978 | Wang et al. | 110/238 |
| 4,132,180 | 1/1979 | Fredrick | 110/265 |
| 4,147,116 | 4/1979 | Graybill | 110/264 |
| 4,206,712 | 6/1980 | Vatsky | 110/264 |
| 4,259,911 | 4/1981 | Jones | 110/245 |
| 4,294,178 | 10/1981 | Borio et al. | 110/347 |
| 4,304,196 | 12/1981 | Chadshay et al. | 110/347 |

*Primary Examiner*—Henry C. Yuen

*Attorney, Agent, or Firm*—Young & Thompson

[57] ABSTRACT

A method for operating a coal dust furnace comprises blowing into the furnace a mixture of combustion air and combustion coal dust having a specified range of grain sizes, the range of grain sizes having an upper limiting grain size, and, for reducing the temperature of the flame, also blowing into the furnace additional temperature reducing coal dust, the range of grain sizes of the additional coal dust lying essentially above the specified upper limiting grain size, this temperature reducing coal dust subsequently being burnt in additional areas of the furnace. The two types of coal dust are blown into the furnace in concentric streams each surrounded by an annular stream of its associated combustion air. If the combustion coal dust is the central stream, then its combustion air is fed in a swirling stream.

6 Claims, 4 Drawing Figures

METHOD FOR OPERATING A COAL DUST FURNACE AND A FURNACE FOR CARRYING OUT THE METHOD

BACKGROUND OF THE INVENTION

This invention relates to a method for operating a coal dust furnace (e.g. a cyclone furnace, SU or turbulent smelting furnace, coal dust furnace with dry ash removal, etc.), in which a mixture of combustion air and combustion coal dust having a specified range of grain sizes is blown into the furnace, the range of grain sizes having an upper limiting grain size, and where means are introduced into the furnace for cooling the flame, this means taking part in the combustion, in order to reduce the combustion temperature. As is well known, the cooling of the flame serves to reduce the formation of nitrous oxides.

Amongst known measures, cold combustion air is introduced as a means for reducing the formation of nitrous oxides. However, the reduction effect achieved is not satisfactory and, in addition, these measures for directly cooling the flame have a disadvantageous effect on the stability of the flame. Moreover, there can be a deterioration in the burning off of carbon, that is, the flue dust and ash or slag contains more carbon. The reduction of the formation of nitrous oxides by directly cooling the flame is therefore not very common in practice in coal dust furnaces. Furthermore, basic investigations have shown that nitrous oxide formation from fuel nitrogen still occurs even when the temperature of the flame has been considerably decreased by introducing cold combustion air. In practice, therefore, other measures for reducing the formation of nitrous oxides have been used, namely near stoichiometric combustion, multi-stage combustion and recirculation of waste gas and in particular the use of fuels which are low in nitrogen.

In contrast to this, the present invention sets out to provide a method for operating a coal dust furnace such that an effective reduction in the formation of nitrous oxides is achieved, also in relation to the formation of nitrous oxides from the fuel nitrogen.

SUMMARY OF THE INVENTION

According to the invention there is provided a method for operating a coal dust furnace wherein a mixture of combustion air and combustion coal dust having a specified range of grain sizes is blown into the furnace, the range of grain sizes having an upper limiting grain size, and wherein, as a means for reducing the temperature of the flame, additional temperature reducing coal dust is blown into the furnace, the range of grain sizes of the additional coal dust lying essentially above said specified upper limiting grain size, this temperature reducing coal dust subsequently being burnt in additional areas of the furnace.

The temperature reducing coal dust will generally be blown into the furnace in a mixture with the combustion coal dust. However, the temperature reducing coal dust can also be introduced into the flow of combustion air and combustion coal dust independently of the combustion coal dust. Therefore, according to the invention, coal dust having different ranges of grain sizes is blown into the coal dust furnace. The first range of grain sizes has a specified upper limiting grain size, that is, the grain size range is according to the hitherto customary grinding, as is necessary to guarantee firing in the furnace.

The second range of grain sizes, the grain size of which lies essentially above the specified upper limiting grain size of the first range, causes a reduction in the temperature of the flame. It is introduced, in order to allow combustion to continue in the flame, when the smallest fractions have been burnt out. By this means it is guaranteed that coal dust is still available to reduce the formation of nitrous oxides in the relatively hot part of the flame. Success is also surprisingly achieved in relation to the fuel nitrogen, which is carried along with the introduced combustion coal dust. Finally, the larger grains from the two ranges contribute towards extending the flame, as it were, whereby afterburning is then carried out. A particularly striking reduction in the formation of nitrous oxides can be achieved if a fuel is used for temperature reducing coal dust which carries along with it only a small amount of fuel nitrogen or even no fuel nitrogen.

The method according to the invention can be combined with other measures for reducing the formation of nitrous oxides. In particular, near stoichiometric combustion can be used. In this connection, in a preferred embodiment of the invention the combustion coal dust, if necessary in a mixture with the temperature reducing coal dust, is blown into the coal dust furnace with a near stoichiometric amount of combustion air, and air is blown into the furnace for the afterburning of the temperature reducing coal dust. This additional air can also be added in near stoichiometric amounts.

A coal dust furnace for carrying out the method described, comprises a combustion chamber, means for supplying a mixture of combustion air and combustion coal dust through at least one burner, which burner is equipped not only for blowing in the combustion coal dust but also for introducing the temperature reducing coal dust, and an afterburning chamber connected to the combustion chamber.

The method according to the invention can also be used in coal dust furnaces in which, in addition to the customary burners for supplying the combustion coal dust, additional blowing devices are provided for the temperature reducing coal dust, or in which, for example, the burners are fitted with a central pipe for blowing in the temperature reducing coal dust.

The advantages obtained can be seen, in that an extremely effective reduction in the formation of nitrous oxides in coal dust furnaces can be achieved without high expenditure, and also in relation to the formation of nitrous oxides from fuel nitrogen. With regard to apparatus, it is of advantage that conventional coal dust furnaces can be used for carrying out the method according to the invention, being easily fitted with an afterburning chamber and, if necessary, with a device for supplying additional combustion air in the afterburning chamber and for introducing the temperature reducing coal dust.

DETAILED DESCRIPTION OF THE PREFERRED EMBODIMENTS

Figure 1:
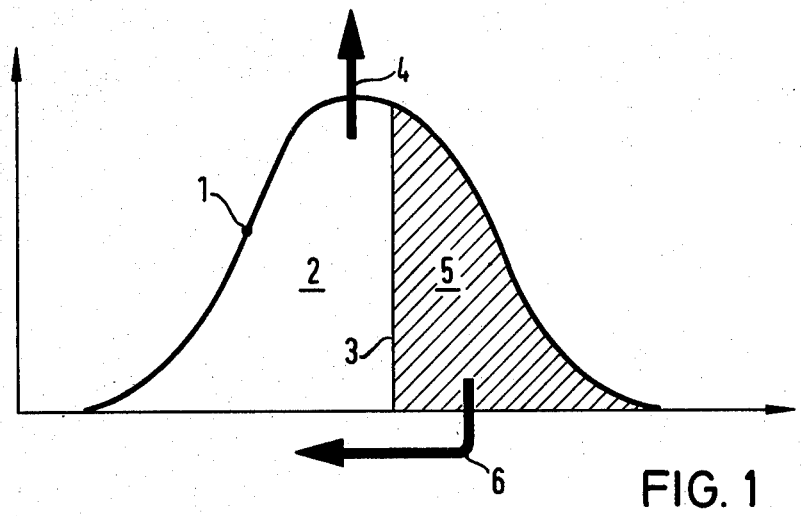
FIG. 1 is a diagrammatic illustration of a conventional method of operating a coal dust furnace.
Figure 2:
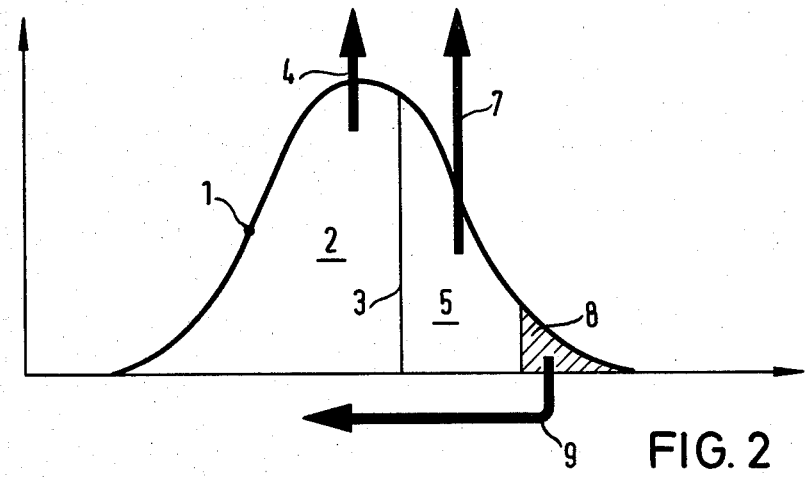
FIGS. 2 and 3 are diagrammatic illustrations of the method according to the invention.
Figure 3:
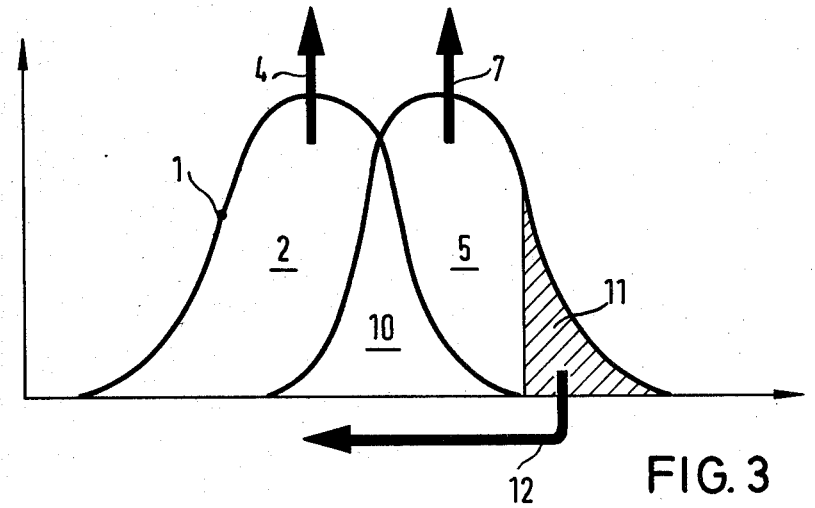

In the diagrammatic illustrations in FIGS. 1 to 3 characteristic distribution curves 1 of the grain sizes of coal dust as a whole are shown. As is well known, characteristic curves of grain sizes are graphical illustrations of the distribution of grain size in a mixture of grains. Usually such characteristic curves of grain size distribution are plotted against a double logarithmic scale, whereby they appear to be practically straight. However, for reasons of clarity, a simple linear scale has been used in FIGS. 1 to 3, whereby on the horizontal axis the grain sizes are shown, and on the vertical axis the amounts of these grain sizes in a quantity of coal dust are shown. The characteristic curves 1 of the grain size are then bell-shaped curves. The range of grain sizes in quantities of coal dust for use in coal dust furnaces is generally continuous.

In FIG. 1 there is indicated at 2 the range of grain sizes in the combustion coal dust with which a classical coal dust furnace is operated. The upper limiting grain size is represented by the line 3; the larger grain sizes can be separated off by means of a grader or sieve. The remaining range of grain sizes is supplied to the furnace, as indicated by the arrow 4. The range of grain sizes which has been separated off, indicated at 5, is generally fed back to the mill, as indicated by the arrow 6.

FIG. 2 shows an embodiment of the invention in which the grain size range 2 of the combustion coal dust conforms with that shown in FIG. 1, and, as is also indicated here by arrow 4, is fed into the furnace. However, a partial range 5 essentially above the upper limiting grain size indicated by the line 3 is also fed to the furnace, as indicated by the second arrow 7. Only an uppermost partial range of grain sizes, indicated at 8, is separated off, and this is fed back to the mill, as indicated by arrow 9. Therefore in this embodiment of the method according to the invention a mill or group of mills can be used whereby a grain size range 5 with grain sizes lying above the specified upper limiting grain size at 3 is nevertheless achieved and is introduced into the furnace as temperature reducing coal dust as indicated by arrow 7.

In the embodiment according to FIG. 3, a grain size range 2 for combustion coal dust and a grain size range 5 for temperature reducing coal dust are shown, and these ranges overlap at 10. The corresponding quantities of coal dust may have been produced, for example, from different mills or groups of mills. Only the grain sizes which are too large are separated off and fed back to the mills, as indicated at 11 and by the arrow 12.

It is clearly shown by FIGS. 2 and 3 that on the one hand a mixture of combustion air and combustion coal dust with a specified range of grain size 2 is blown into the coal dust furnace, this range of grain size having an upper limiting grain size 3, and that additional cooling coal dust is blown into the furnace as a means for reducing the temperature of the flame, this grain size range 5 lying essentially above the specified upper limiting grain size 3.

Figure 4:
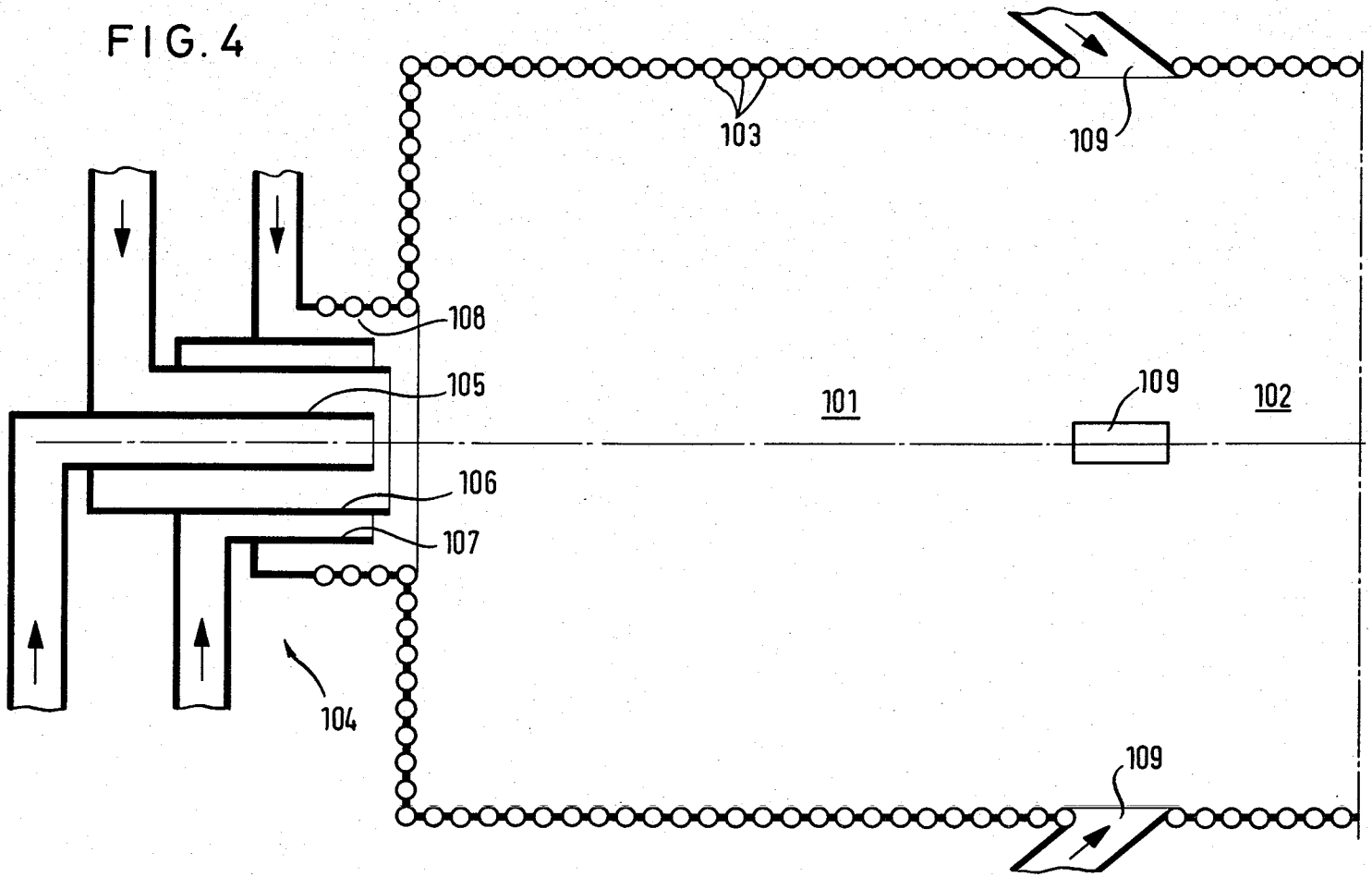
FIG. 4 is a longitudinal section through a coal dust furnace which is equipped for carrying out the method according to the invention.

The temperature reducing coal dust is burnt afterwards in additional areas of the cooled coal dust furnace. This is illustrated in FIG. 4, which shows a coal dust furnace for carrying out the method according to the invention. The furnace comprises a combustion chamber 101, 102 which is cooled by means of cooling pipes 103. Furthermore, the coal dust furnace has a device 104, generally referred to as a burner, for the supply of combustion air, combustion coal dust and temperature reducing coal dust. The combustion coal dust along with its entraining air is fed through a central pipe 105. The pipe 105 is surrounded concentrically by a supply pipe 106 for the combustion air. The combustion air fed through the annular space thus formed is fed spirally. The temperature reducing coal dust along with its entraining air is fed through a pipe 107 which concentrically surrounds the supply pipe 106 for the combustion air. The temperature reducing coal dust is fed into the combustion chamber 101, 102 in a dense, pulsing stream and reaches area 102 which is an extension of the combustion chamber 101 and forms an afterburning chamber. The stream of temperature reducing coal dust is surrounded by non-spiralling air which is fed through another concentric supply pipe 108 for combustion air. The afterburning chamber 102 could also have additional devices 109 for the supply of combustion air. Within the scope of the invention it is possible to interchange the supply of temperature reducing coal dust and combustion coal dust. However, then the combustion air fed through the pipe 106 is not fed spirally. The combustion air fed outside can in this case be fed spirally or non-spirally.

I claim:

1. A method for operating a coal dust furnace with reduced formation of nitrogen oxides, comprising the steps of:

blowing into the furnace a mixture of air and combustion coal dust having a specified range of grain sizes, the range of grain sizes having an upper limiting grain size, blowing into the furnace a swirling stream of combustion air surrounding said mixture;

blowing into the furnace a mixture of combustion air and temperature reducing coal dust surrounding said swirling stream of combustion air, the range of grain sizes of the additional coal dust lying essentially above said upper limiting grain size;

blowing into the furnace a non-swirling stream of combustion air surrounding said mixture of air and temperature reducing coal dust, and burning said temperature reducing coal dust in an afterburning area of the furnace.

2. A method according to claim 1, wherein the combustion coat dust is blown into the furnace with a near stoichiometric amount of combustion air, and wherein additional air is blown into the furnace for the afterburning of the temperature reducing coal dust.

3. A method according to claim 2, wherein the additional air for the afterburning of the temperature reducing coal dust is also blown into the furnace in a near stoichiometric amount.

4. A method for operating a coal dust furnace with reduced formation of nitrogen oxides, comprising the steps of:

blowing into the furnace a mixture of air and temperature reducing coal dust, blowing into the furnace a non-swirling stream of combustion air surrounding said mixture of air and temperature reducing coal dust, blowing into the furnace a mixture of air and combustion coal dust having a specified range of grain sizes, the range of grain sizes having an upper limiting grain size and the mixture surrounding said non-swirling stream of combustion air, blowing into the furnace a stream of combustion air surrounding said mixture of air and combustion coal dust, the range of grain sizes of the temperature reducing coal dust lying essentially above said upper limiting grain size and burning said temperature reducing coal dust in an afterburning area of the furnace.

5. A method according to claim 4, wherein the combustion coal dust is blown into the furnace with a near stoichiometric amount of combustion air, and wherein additional air is blown into the furnace for the afterburning of the temperature reducing coal dust.

6. A method according to claim 5, wherein the additional air for the afterburning of the temperature reducing coal dust is also blown into the furnace in a near stoichiometric amount.

* * * * *

UNITED STATES PATENT AND TRADEMARK OFFICE

CERTIFICATE OF CORRECTION

PATENT NO. : 4,367,686

DATED : January 11, 1983

INVENTOR(S) : Fritz Adrian

It is certified that error appears in the above-identified patent and that said Letters Patent is hereby corrected as shown below:

On the title page Insert:

-- (30) Foreign Application Priority Data

March 26, 1980 Germany 3011631 --

Signed and Sealed this

*Twelfth* Day of *April 1983*

[SEAL]

*Attest:*

GERALD J. MOSSINGHOFF

*Attesting Officer* *Commissioner of Patents and Trademarks*